US005092064A

United States Patent [19]

Lee

[11] Patent Number: 5,092,064

[45] Date of Patent: Mar. 3, 1992

[54] LIQUID-DROP MODEL DIAGRAMATIC INDICATOR PLATE STRUCTURE

[76] Inventor: Vincent K. W. Lee, No. 44, Lane 458, Sheh Chung Street, Taipei, Taiwan

[21] Appl. No.: 567,805

[22] Filed: Aug. 15, 1990

[51] Int. Cl.[5] ..... G09F 19/00

[52] U.S. Cl. ..... 40/406; 273/1 L

[58] Field of Search ..... 40/409, 410, 406, 407; 446/166, 267; 273/1 L, 115

[56] References Cited

U.S. PATENT DOCUMENTS 690,852 1/1902 Gordon ..... 40/410

3,101,564 8/1963 Stoessel ..... 40/407

4,489,939 12/1984 Spector ..... 273/1 L 4,756,692 7/1988 Pronger ..... 273/1 L

*Primary Examiner*—Kenneth J. Dorner

*Assistant Examiner*—Cassandra Hope

*Attorney, Agent, or Firm*—Ladas & Parry

[57] ABSTRACT

A kind of latest liquid-drop model diagramatic drawings indicator plate structure refers to a kind of decoration which may present the pre-set excellent and colorful diagramatic drawings of structures designed in the assembled liquid-drops instruments.

7 Claims, 5 Drawing Sheets

LIQUID-DROP MODEL DIAGRAMATIC INDICATOR PLATE STRUCTURE

BACKGROUND OF THE INVENTION

The liquid has been used for the developments of various decorative articles for several years. This has been fully disclosed in the U.S. Pat. Nos. 3,738,036, 4,740,046, 2,484,116, 3,100,418, 3,438,197, 3,553,959, 3,438,197, 4,738,888, 4,359,224, 2,776,141, 783,357, as well as in the Japanese chartered patents Reference 59-15885 which has been declared, and the West Germany Patent Application of reference number 518160 etc. Such disclosures are concerned with the using of liquid as the various decorations.

However, the creation ideas of such products are different with the contents of this invention. Despite of their developments into the liquid decorations, their techniques are varied respectively and the effects are different. For instance, the structure of this invention is to add in the color liquid with dropping model to enable its flowing on the sliding surface plate thoroughly and evenly and to retain certain portions of color liquid in the multiple tiny holes pre-set on the surface plate. The purpose of this means is to present colorful diagrams pre-set on the surface plate eventually. The peculiarity demonstrated by this structure and efficacy is an important part which is hardly found in the afore-mentioned articles of similar categories. It is also the patent portion of this invention under application.

SUMMARY OF THE INVENTION

This invention is the provision of a type of diagramatic indicator plate with the latest structure, that is referred particularly to a liquid-drop model, to enable the dropping of color liquid to evenly flow through a sliding surface plate and certain portion of color liquid may be retained in the multiple holes pre-set on the surface plate. When the dropping is terminated and the color liquid is leaving the surface plate gradually, the assembling of color liquid in such tiny holes may eventually and brightly demonstrate the pre-set diagrams on the surface plate.

DESCRIPTION OF THE PREFERRED EMBODIMENT

Figure 1:
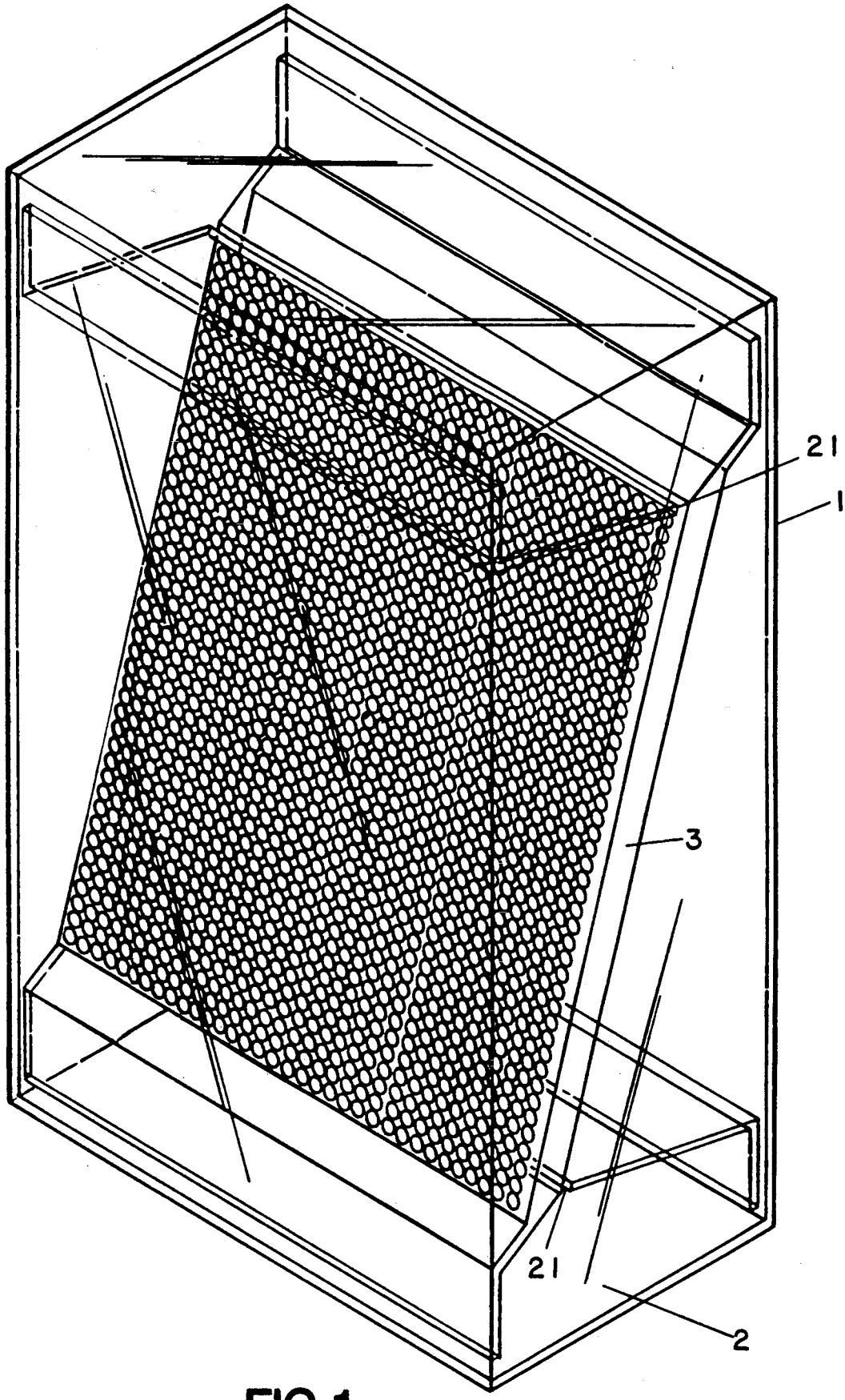
FIG. 1 attached is the symmetrical appearance indication drawing of this invention.
Figure 2:
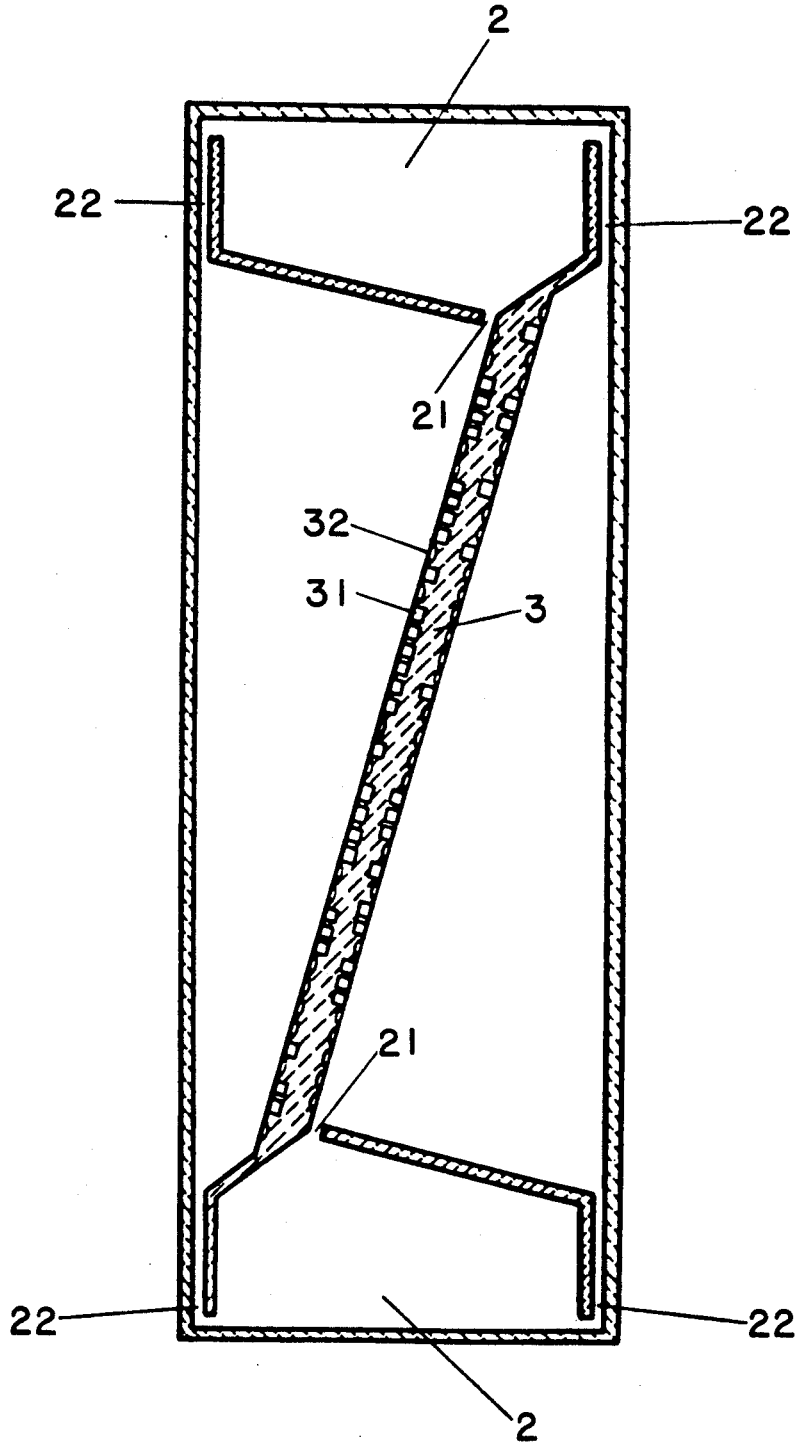
FIG. 2 attached is the side-sectional indication drawing of this invention.

Please refer to the indications of FIG. 1 and FIG. 2 attached. The preferred embodiment includes the housing (1) and the reservoir (2) established at both the upper and lower terminals interiorly. An exit groove (21) presented with a linear shaped opening is established at the reservoir (2) respectively to match with two reflowing grooves (22).

Figure 3:
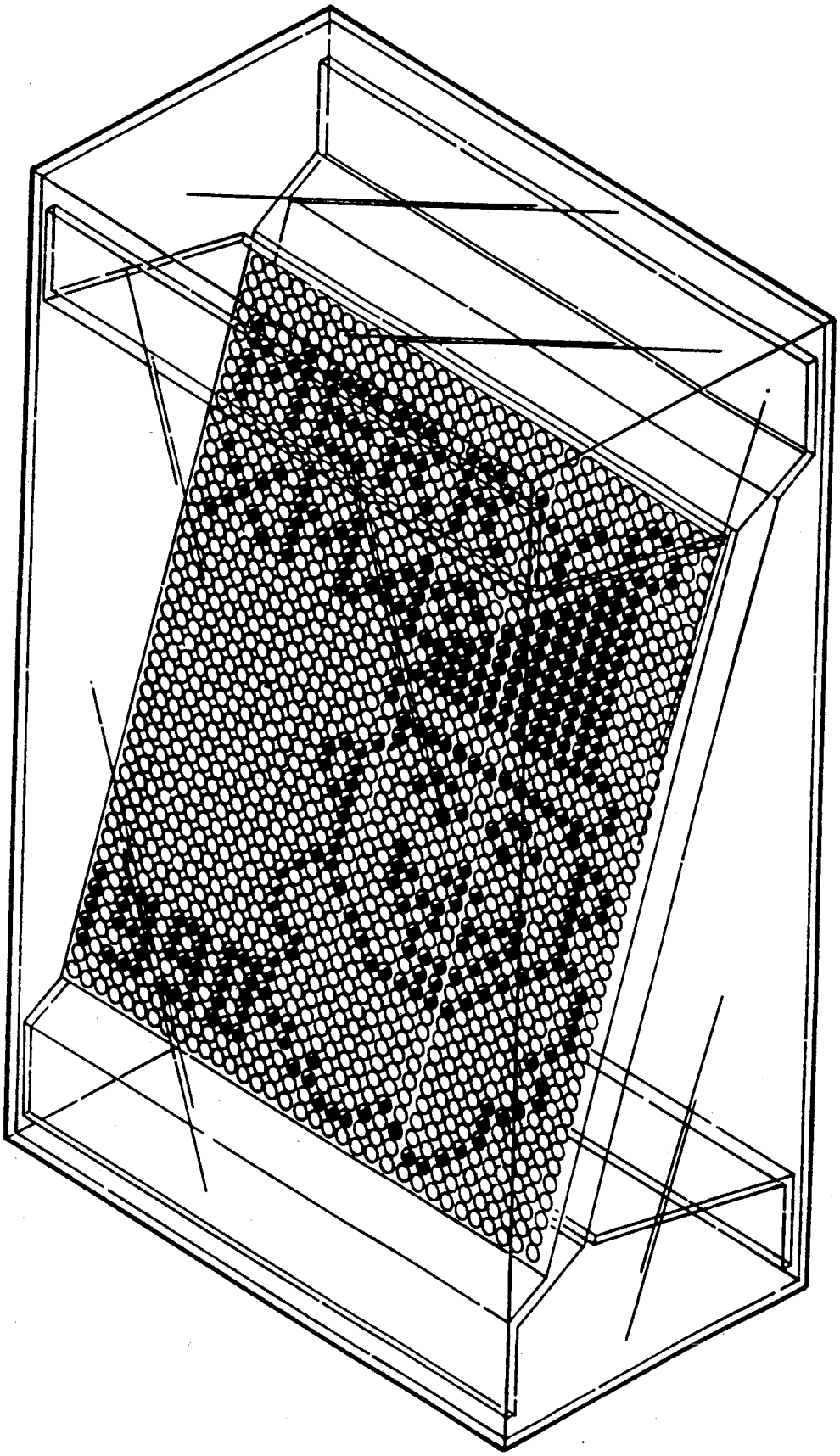
FIG. 3 attached is the surface plate illustrative drawing of this invention.
Figure 4:
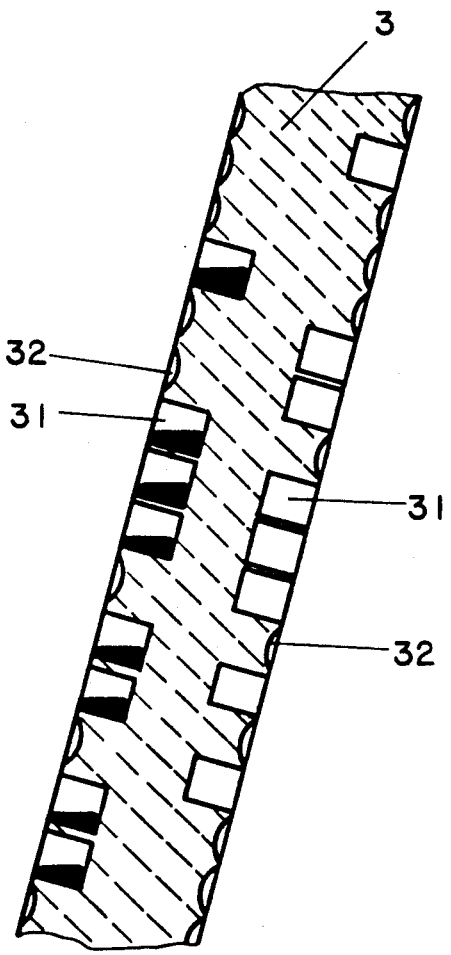
FIG. 4 attached is an enlarged sectional drawing of the surface plate of this invention.

The color liquid and the transparent liquid with lower specific gravity than the color liquid (such as oily liquid) have been installed in the entire housing. The color liquid will therefore always move to the bottom and the transparent liquid to the top. A surface plate (3) located at a certain angle is clipped in between the upper and lower exit groove (21). Such surface plate (3), with adequate thickness, is for the watching purpose of the diagramatic indications. Further, multiple tiny holes (31) established on both surfaces in the front and at the back may be arranged with various styles of drawings according to the designs, as the drawings or the letterings shown in the FIG. 3, the drawings on both the surfaces may be separated for design purposes to increase the variations. Such tiny holes (31) are the concave surface of the surface plate (3) with irregular shapes and it may be designed as the concave holes of cylindrical shape as indicated in the concave hole (31) in FIG. 4. The vacant portion shown on the surface without the concave holes may be complimented with shallow circular holes (32).

The different effect of the concave holes and the shallow circular holes is that the concave holes (31) are deeper and this sliding angle of the surface plate (3) may enable the retaining of color liquid in the concave holes (31) during the flowing of the liquid from the upper part to the lower part through the concave holes (31) and the shallow circular holes (32) owing to the different depth and the circular arc of the shallow circular holes (32). However, the liquid flowing through the shallow circular holes (32) are not and no effects will be caused to the indication of the final drawings. The main reason of additional establishment of shallow circular holes is to enable the close distributions of circular holes evenly on the entire surface plate (3).

As the circular diameters of the concave holes (31) and the shallow circular holes are the same and thus the intended drawings are hardly seen as we view simply from the surface plate (3). It will only be demonstrated upon the liquid-drop through the matching of color liquid slowly and under such circumstances, the covering effects of the shallow circular holes (32) may add-in the variation and peculiarity of the diagramatic indication. Besides, when the liquid-drop begins, the color liquid is flowing out from the upper exit groove (21) and as this exit groove (21) is an linear opening, the color liquid may flow down through the entire surface to cover the entire surface plate (3). Transparent liquid moves up to replace the color liquid which has flowed down. During the following of the color liquid, part of the color liquid will be retained according to the positions of the concave holes (31). Upon the out-flows of the color liquid in the upper reservoir (2) thoroughly and gradually flowing from the upper part of the surface plate downward and away from the surface plate, the diagrams constituted by the concave holes (31) retained with the color liquid will also be presented in the portions whre the color liquid has left completely, as indicated in the drawing MERRY X'MAS, 1990 and Santa Claus drawings.

In short, the drawing on the surface plate is gradually formed from the upper side to the bottom during the retreats of the color liquid from the surface plate gradually and flow downwards, as the diagrams. The process of gradual sketches of diagrams to the demonstration of the final and complete diagramatic drawings are full of variations and peculiarity. At the end of the entire process, the reversion of the housing (1) may enable the color liquid on a surface of the original diagramatic drawing to pour out and flow to the lower reservoir through the reversion of the sliding angle of the surface plate (3), and thus the drawings may be disappeared at the same time. Further, the color liquid retained in the lower reservoir may begin the presenting process of other diagramatic drawings on the surface plate (3) owing to the reversion. Such reversion of the entire housing may enable the liquid-drop of the color liquid on both sides of the surface plates rotatively and the action of the diagramatic drawings may be presented. Besides, the changes of other related techniques are enabled in the respect of diagramatic drawings presentation of this invention. For example, parts of the diagramatic drawings with varied colors may be printed in advance on the surface plate and another part of diagramatic drawings may also be presented with color liquid, and the complete diagram may be done finally, or the surface plate and color liquid as well as another transparent liquid may be used for comparison to each other for variations and the diagramatic drawings may also be demonstrated brightly and colorfully without using the transparent liquid. Even the alignments of multiple holes may be closely distributed unevenly on the surface plates.

Figure 6:
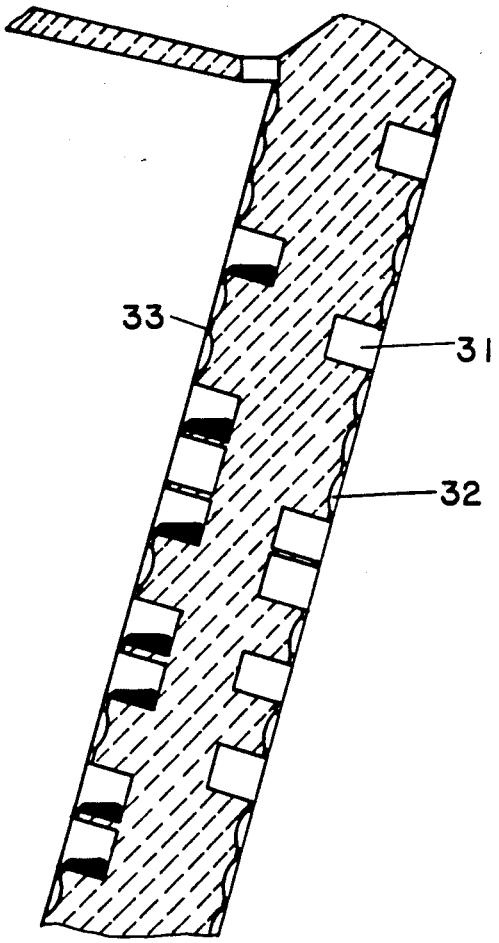
FIG. 6 attached is the enlarged sectional illustrative surface plate drawing of this invention.
Figure 5:
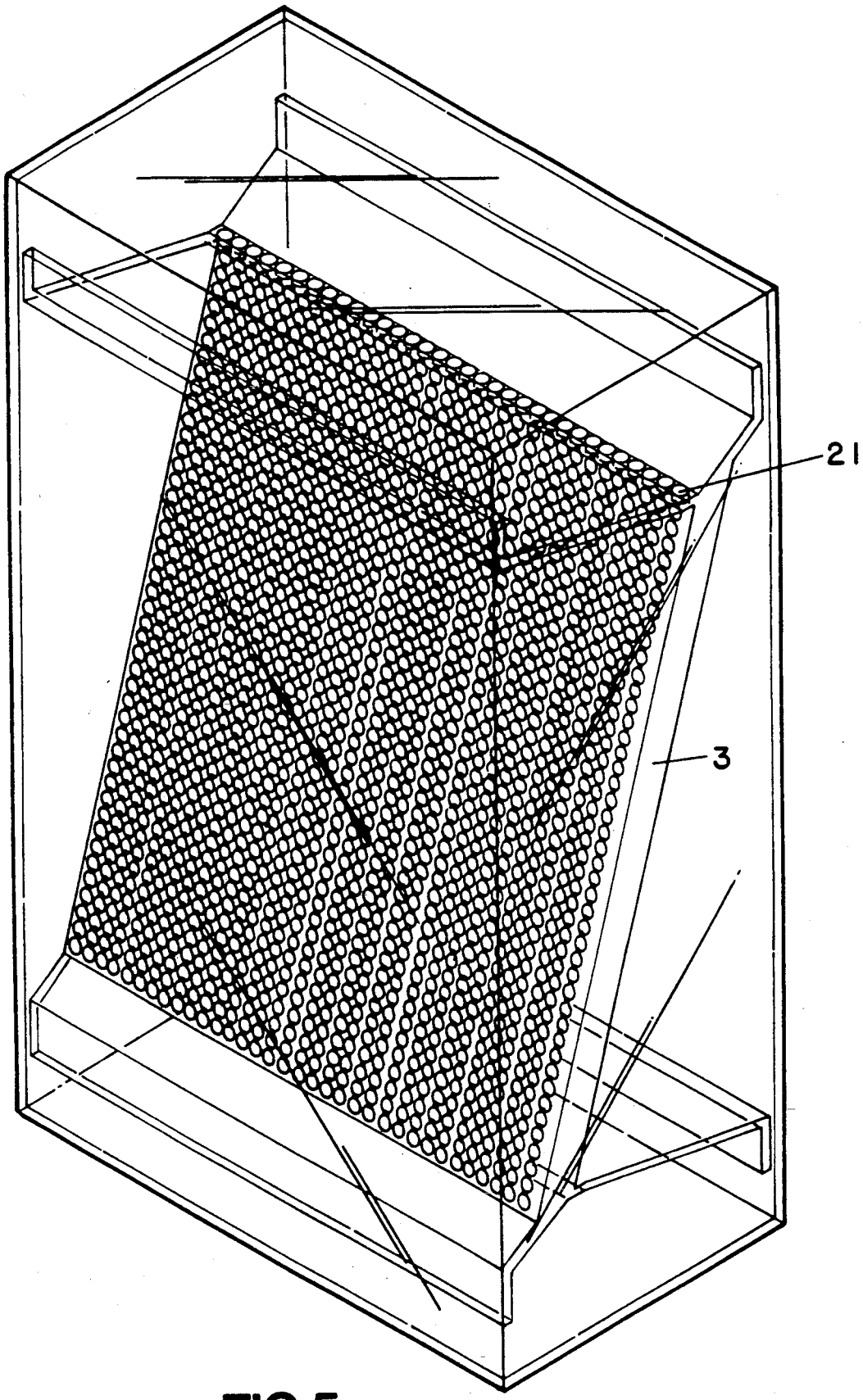
FIG. 5 attached is another illustrative indication drawing of surface plate of this invention.

The indications in FIG. 5 and FIG. 6 is another illustrative diagram of this invention. In order to conduct the demonstration of diagramatic drawings in a smoothly manner, the clearance between each concave hole (31) and shallow circular hole (32) vertically lined and and aligned on the surface plate (3) is joined with a concave groove (33) with adequate depth to form several vertical slotted groove aligned on the surface plate and the exit groove portion (21) is changed to the formation of dropping holes of equal number with that concave groove. Then the color liquid will be dropped out from the reservoir (2) through the dropping hole of concave groove on the exit groove (21), and the color liquid will flow downwards vertically along the concave groove (33). The color liquid will fill up the concave holes and upon parts of the color liquid being retained in the holes, the liquid will flow further downward and will pass through the shallow circular holes without retaining any color liquid.

Under such circumstances, the entire surface plate will just like the window glass poured with heavy rains and formed by multiple color lines. From upwards to downwards in sequence the concave holes (31) are retained with color liquid and the diagramatic drawing may be presented eventually and accordingly. As this type of structure is a type of design of the color liquid flowings, it shall be deemed as the extended design of this invention and shall be covered in the protection range of this patent.

I claim:

1. A liquid drop device comprising:

a transparent housing having first and second ends;

a first liquid in the housing;

a second liquid in the housing, the second liquid being of greater specific gravity and different color to the first liquid;

a reservoir located at each end of the housing, the remainder of the housing forming a chamber;

an entrance and exit opening between each reservoir and the chamber to permit flow of the second liquid between the reservoir and the chamber;

a surface plate located in the housing between the reservoirs and inclined within the housing, the surface plate being located with respect to the openings such that the second liquid flowing from one of the reservoir through the corresponding exit openings flows over the surface plate; and a plurality of relatively small recesses in the surface plate, each recess being adapted to hold a small amount of the second liquid.

2. A liquid drop device as claimed in claim 1 wherein the surface plate further has a plurality of concave grooves therein defining a grid pattern.

3. A liquid drop device as claimed in claim 2 wherein the recesses and the grooves have circular openings of substantially the same diameter, the recesses and grooves being located on the surface plate in a grid like fashion, the recesses being of sufficient depth to entrap small amounts of the colored second liquid, the grooves being sufficiently shallow to prevent entrapment of any of the second liquid therein.

4. A liquid drop device as claimed in claim 1 wherein the plurality of recesses are arranged on the surface plate such that, when each recess contains a small amount of the second liquid, the totality of recesses define with the different color a pattern or message.

5. A liquid drop device as claimed in claim 1 wherein the second liquid substantially fills a reservoir when at rest on the first end, and upon rotation of the device on to the second end, the second liquid flows through the exit opening, over the surface plate and into the reservoir located at the second end, wherein small portions of the second liquid of different color remain temporarily trapped in the plurality of recesses to define a pattern, the second liquid moving through the medium of the first liquid in flowing from the reservoir at the first end to the reservoir at the second end.

6. A liquid drop device as claimed in claim 1 wherein the surface plate includes two surfaces, each surface having a plurality of recesses therein.

7. A liquid drop device as claimed in claim 6 wherein the plurality of recesses on each surface of the surface plate are differently arranged such that the plurality of recesses on each side form different patterns or shapes.

* * * * *